US009196967B2

(12) United States Patent
Huang et al.

(10) Patent No.: US 9,196,967 B2
(45) Date of Patent: Nov. 24, 2015

(54) BEAMWIDTH ADJUSTMENT DEVICE

(75) Inventors: Chang-Hsiu Huang, Hsinchu (TW); Shun-Chung Kuo, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 403 days.

(21) Appl. No.: 12/943,905

(22) Filed: Nov. 10, 2010

(65) Prior Publication Data

US 2012/0086618 A1 Apr. 12, 2012

(30) Foreign Application Priority Data

Oct. 7, 2010 (TW) ..... 099134175 A

(51) Int. Cl.
*H01Q 13/00* (2006.01)
*H01Q 19/08* (2006.01)

(52) U.S. Cl.
CPC ..... *H01Q 19/08* (2013.01)

(58) Field of Classification Search
CPC ... H01Q 21/064; H01Q 19/192; H01Q 13/00; H01Q 1/288; H01Q 13/02
USPC ..... 343/772, 786, 781 R, 840, 781 P, 343/781 CA, 784
See application file for complete search history.

(56) References Cited

U.S. PATENT DOCUMENTS

| | | | | |
|---|---|---|---|---|
| 4,042,935 | A * | 8/1977 | Ajioka et al. | 343/795 |
| 4,168,504 | A * | 9/1979 | Davis | 343/786 |
| 6,008,772 | A * | 12/1999 | Legay et al. | 343/787 |
| 6,356,241 | B1 * | 3/2002 | Jaeger et al. | 343/789 |
| 6,700,549 | B2 * | 3/2004 | Holzman | 343/772 |
| 6,943,744 | B1 * | 9/2005 | Vezmar | 343/756 |
| 7,202,834 | B2 * | 4/2007 | Nagano et al. | 343/786 |
| 7,236,681 | B2 * | 6/2007 | Moheb et al. | 385/147 |

* cited by examiner

*Primary Examiner* — Dameon E Levi
*Assistant Examiner* — Hasan Islam
(74) *Attorney, Agent, or Firm* — Winston Hsu; Scott Margo

(57) ABSTRACT

A beamwidth adjustment device, which is used for a feedhorn comprising an opening and a ring encircling the opening, comprises a conductor used for adjusting beamwidth formed by the feedhorn according to a characteristic of a dish of a satellite antenna corresponding to the feedhorn, and a fixing element used for fixing the conductor to the feedhorn, wherein the satellite antenna is used for receiving signals from the feedhorn.

7 Claims, 10 Drawing Sheets

| Feedhorn with feed cap | Beamwidth (Degree) | |
|---|---|---|
| 10.7(GHz) | Average_10dB | Gain |
| Without beamwidth adjustment device | 80.22 | 13.22 |
| Beamwidth adjustment device with orthogonal-cross design | 69.35 | 13.85 |
| Beamwidth adjustment device with cocentric-circle design | 92.66 | 11.85 |

FIG. 10

BEAMWIDTH ADJUSTMENT DEVICE

BACKGROUND OF THE INVENTION

1. Field of the Invention

The present invention relates to a beamwidth adjustment device, and more particularly, to a beamwidth adjustment device for adjusting a beamwidth formed by a feedhorn.

2. Description of the Prior Art

Satellite communication is distinguished in wide coverage and terrestrial interference avoidance, and is widely used in military, probe, and commercial communication services, such as satellite navigation, satellite voice broadcasting, and satellite television broadcasting. A conventional satellite communication receiving device consists of a dish reflector and a low noise block down-converter with feedhorn (LNBF). The LNBF is disposed on the focus of the dish reflector, and is used for receiving radio signals reflected via the dish reflector, down-converting the radio signals to middle band, and then transmitting the radio signals to a backend satellite signal processor for signal processing, thereby enabling the playing of satellite television programs.

The LNBF is composed of a feedhorn, a waveguide and a low noise block down-converter (LNB). The feedhorn is used for collecting signals reflected by a satellite antenna to the waveguide, to output to the LNB. Except receiving satellite signals, the feedhorn can transmit signals (reflected via the dish reflector) to the satellite for different applications.

The reception quality of the satellite antenna is significant related to the placed position of the feedhorn. For example, the feedhorn radiates electromagnetic waves from a focal position of the satellite antenna, and thereby the electromagnetic waves are reflected to the satellite via the dish reflector. A number of signals that can be received by the satellite antenna is decreased when the feedhorn is deviated from the focal position. In practice, the focal position is represented by a focal length to diameter ratio (F/D) of the dish. Note that, the reception efficiency of the satellite antenna is affected by whether the focal length to diameter ratio (hereafter called F/D value) of the dish matches a beamwidth formed by the feedhorn. In other words, different F/D design requires different values of the beamwidth, so that the beams emitted from the feedhorn can be efficiently received by the satellite antenna. For example, a dish with F/D=0.6 requires a narrower beamwidth compared to a dish with F/D=0.4. If the beamwidth does not conform the F/D design of the dish (e.g. too wide or too narrow), reception efficiency of the satellite antenna is affected, thereby lowering the reception quality of the satellite antenna.

However, a device for adjusting the beamwidth formed by the feedhorn has never been provided in the current market, so that the beamwidth formed by the feedhorn may not match the dish perfectly. In addition, in the beginning of product design, manufacture companies take much effort to reduce size of products, toward compact products and low cost. Therefore, under reduction of an opening size of the feedhorn, how to match the beamwidth and the dish is a topic for discussion.

SUMMARY OF THE INVENTION

Therefore, the present invention provides a beamwidth adjustment device for a feedhorn, for adjusting a beamwidth formed by the feedhorn, so as to perfectly match the beamwidth with a dish of a satellite antenna.

The present invention discloses a beamwidth adjustment device for a feedhorn comprising an opening and a ring encircling the opening. The beamwidth adjustment device comprises a conductor for adjusting beamwidth formed by the feedhorn according to a characteristic of a dish of a satellite antenna corresponding to the feedhorn, and a fixing element for fixing the conductor to the feedhorn, wherein the satellite antenna is used for receiving signals from the feedhorn.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 10 is a comparison table of beamwidths in FIG. 7-FIG. 9.

DETAILED DESCRIPTION

Figure 1:
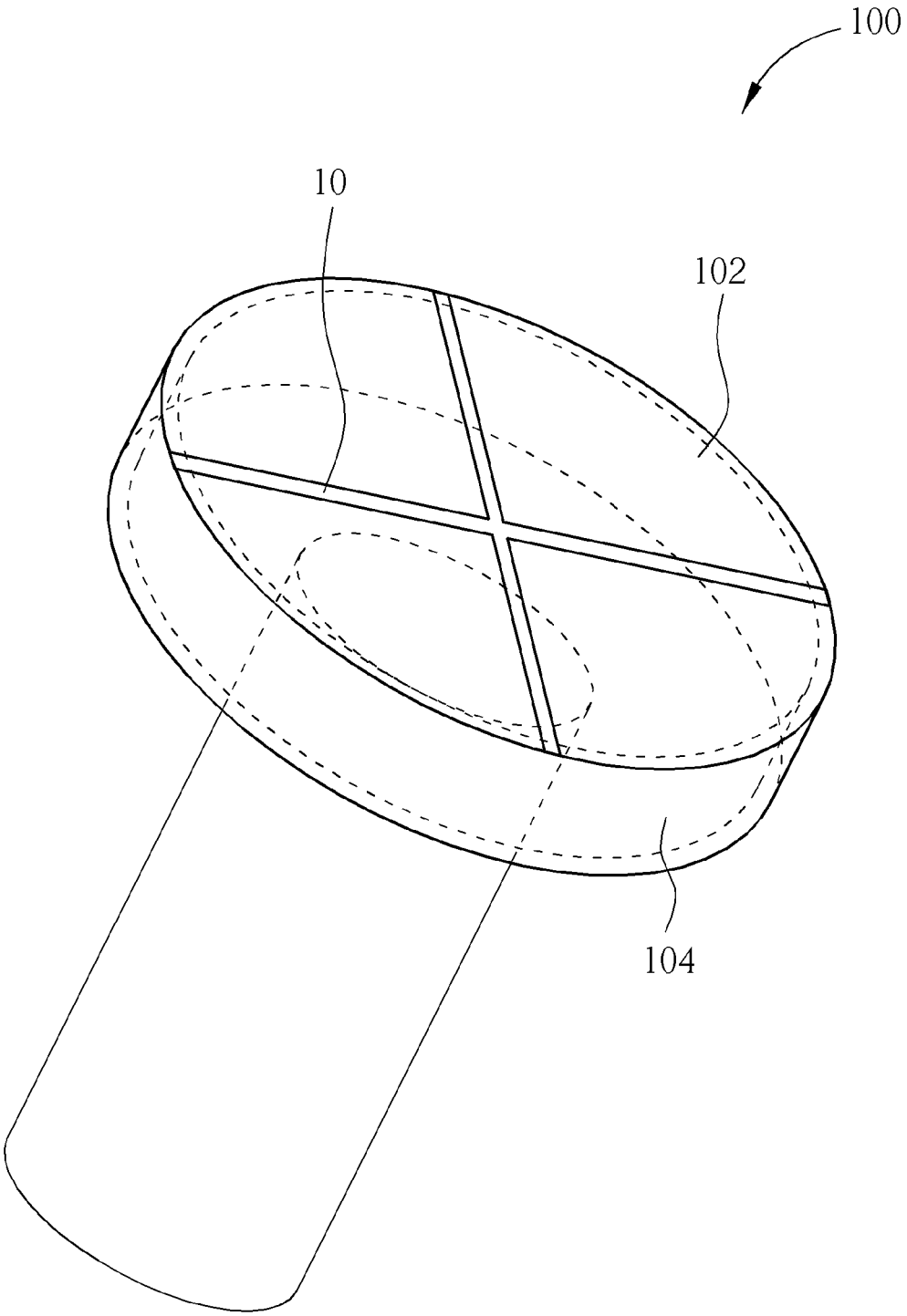
FIG. 1 is a schematic diagram of a beamwidth adjustment device used for a feedhorn according to an embodiment of the present invention.

Please refer to FIG. 1, which is a schematic diagram of a beamwidth adjustment device 10 according to an embodiment of the present invention. The beamwidth adjustment device 10 is used in a feedhorn 100. The feedhorn 100 includes an opening 102 and a ring 104 encircling the opening 102. In FIG. 1, the beamwidth adjustment device 10 is composed of a conductor used for adjusting beamwidth formed by the feedhorn 100 according to a characteristic of a dish of a satellite antenna (not shown in FIG. 1) corresponding to the feedhorn 100. The characteristic of the dish is a focal length to diameter radio (F/D). Note that, a shape of the conductor of the beamwidth adjustment device 10 can be a symmetric geometrical shape, such as orthogonal cross, concentric circle, spot eccentric circle, or radiative distribution, etc., and the conductor is placed above, below or in the same plane of the opening 102 of the feedhorn 100 by a fixed component (shown in FIG. 1). The fixed component is mainly used for fixing the conductor at the feedhorn 100, as other components and methods obtaining the same objective belong to the claimed invention. For example, the fixed component is a weld, so that the conductor can be welded at the outer rim of the opening 102 or the inner surface of the ring 104 of the feedhorn, or is a pillar extending from the ring 104 to the opening 102, so that the conductor can be installed on the top of the pillar, so as to reach the goal of fixing the conductor at the feedhorn 100. In brief, the beamwidth is modified according to a size, a shape, or a position of the conductor placed at the feedhorn 100. Therefore, the present invention can adjust a width of abeam emitted from the feedhorn 100 to the satellite antenna through the beamwidth adjustment device 10, thereby increasing signal reception efficiency of the satellite antenna, so as to enhance the reception quality. Furthermore, the present invention can perfectly match the feedhorn 100 to different satellite antennas (e.g. different F/D design).

In FIG. 1, the beamwidth adjustment device 10 is a design of orthogonal polarization, and is capable of reflecting to extend an electric field feedback path and gather current so that the directionality of the beam can be enhanced, to reach the goal of gathering beams, thereby avoiding that a part of beams with wider beamwidth cannot be received, so as to increase reception efficiency of the satellite antenna. The design of the orthogonal polarization can be symmetrical or asymmetrical orthogonal (e.g. length, width or height). In addition, a size of the opening of the feedhorn 100 can be decreased without affecting a match with the dish when the beamwidth is decreased by the beamwidth adjustment device 10, so as to reduce the manufacture cost.

As can be seen, when the size of the opening of the feedhorn 100 is fixed, the feedhorn 100 can match the dish perfectly with the beamwidth adjustment device 10, so as to increase the reception quality. On the other hand, when the opening size of the feedhorn 100 is decreased, the beamwidth can be maintained or optimized via the beamwidth adjustment device 10 of the present invention. Therefore, the area of the opening of the feedhorn 100 can be reduced efficiently, to increase a feasibility of installation with multiple satellite antennas.

Note that, the beamwidth adjustment device 10 of the present invention can be applied into any kind of feedhorns, such as conical, pyramidal, corrugated, dielectric-load, lens-corrected, dielectric or array, etc., or into different shapes of the opening, such as a square, circle, rectangle, rhombus or ellipse, etc.

Figure 2:
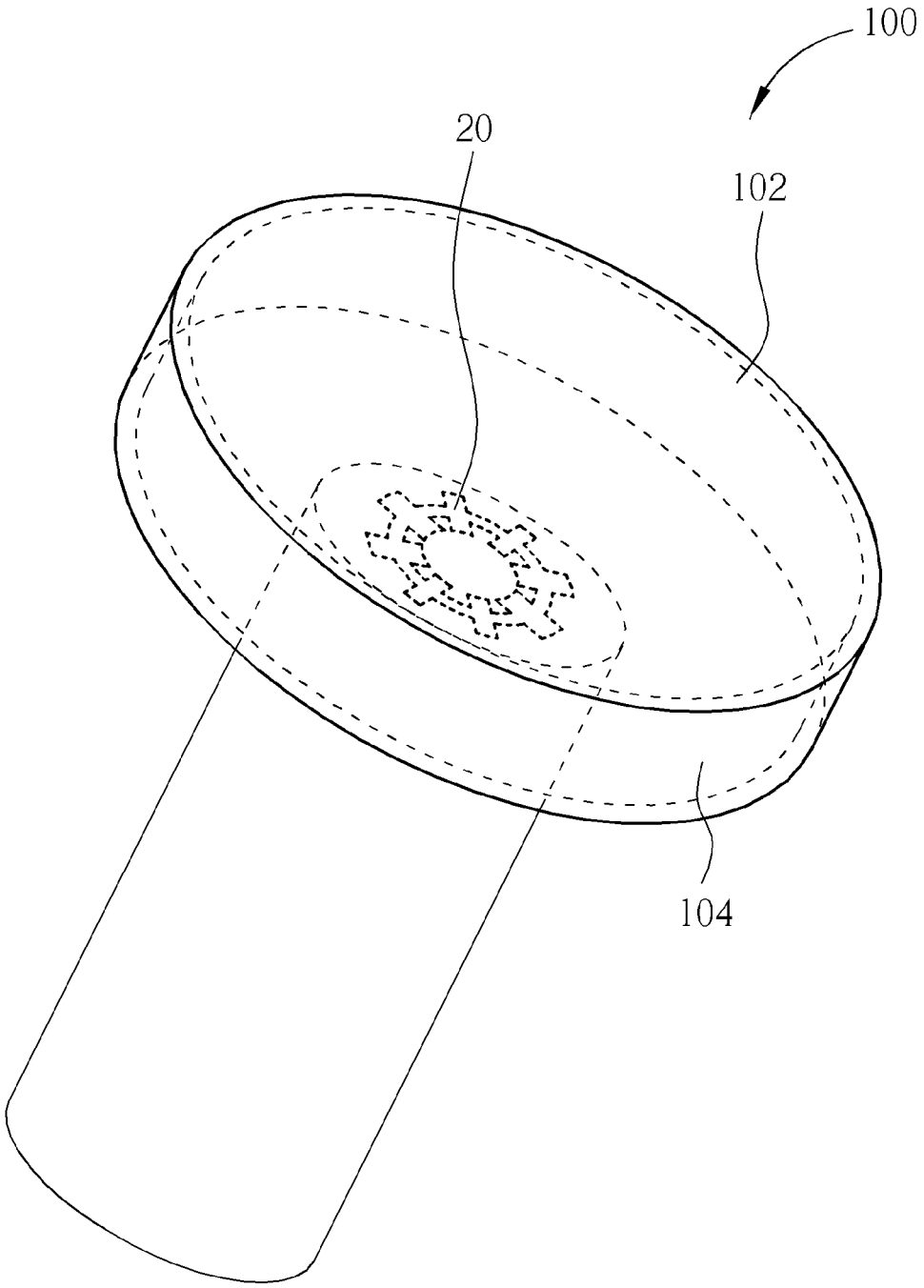
FIG. 2-FIG. 5 are schematic diagrams of beamwidth adjustment devices according to embodiments of the present invention.
Figure 3:
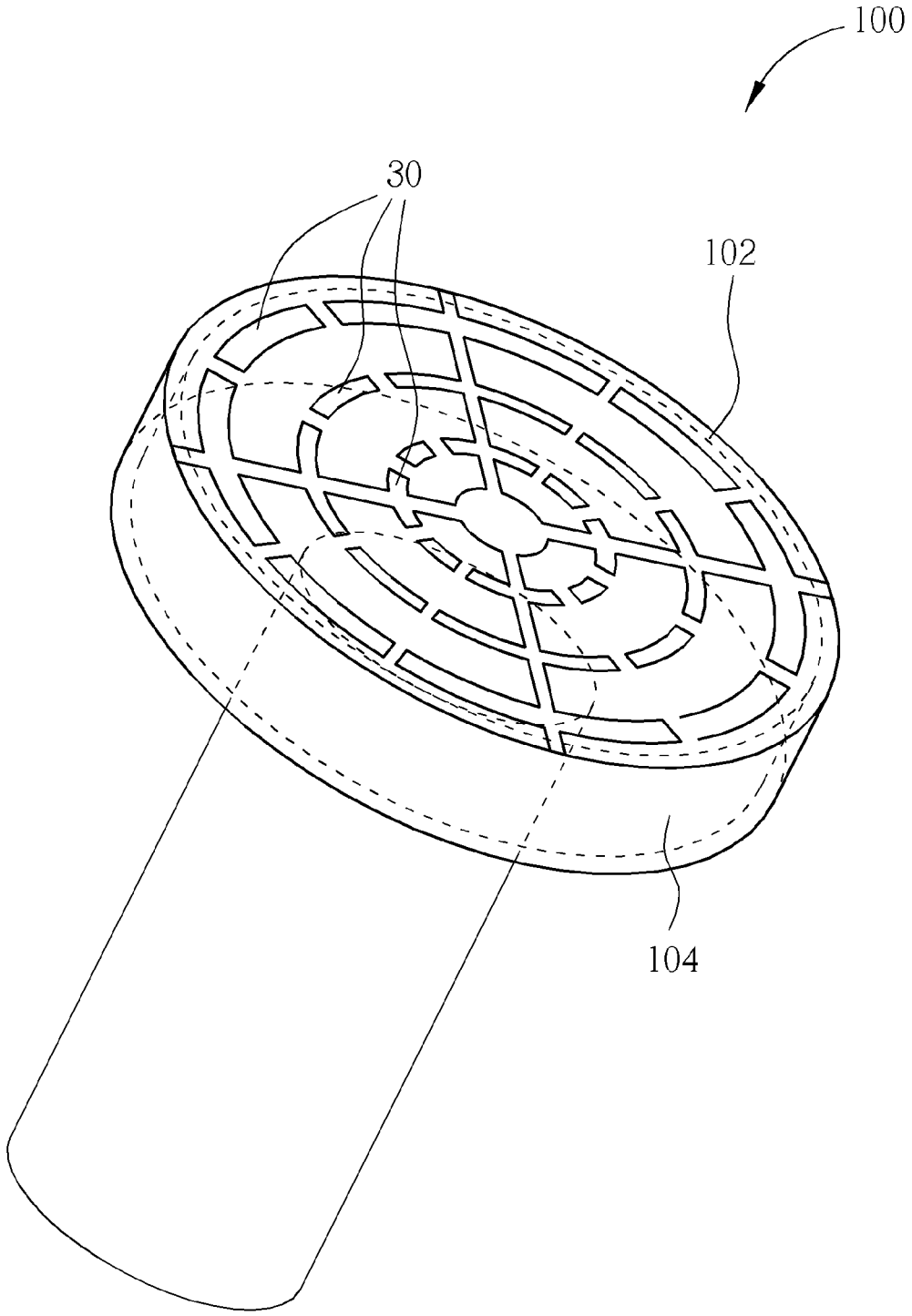
Figure 4:
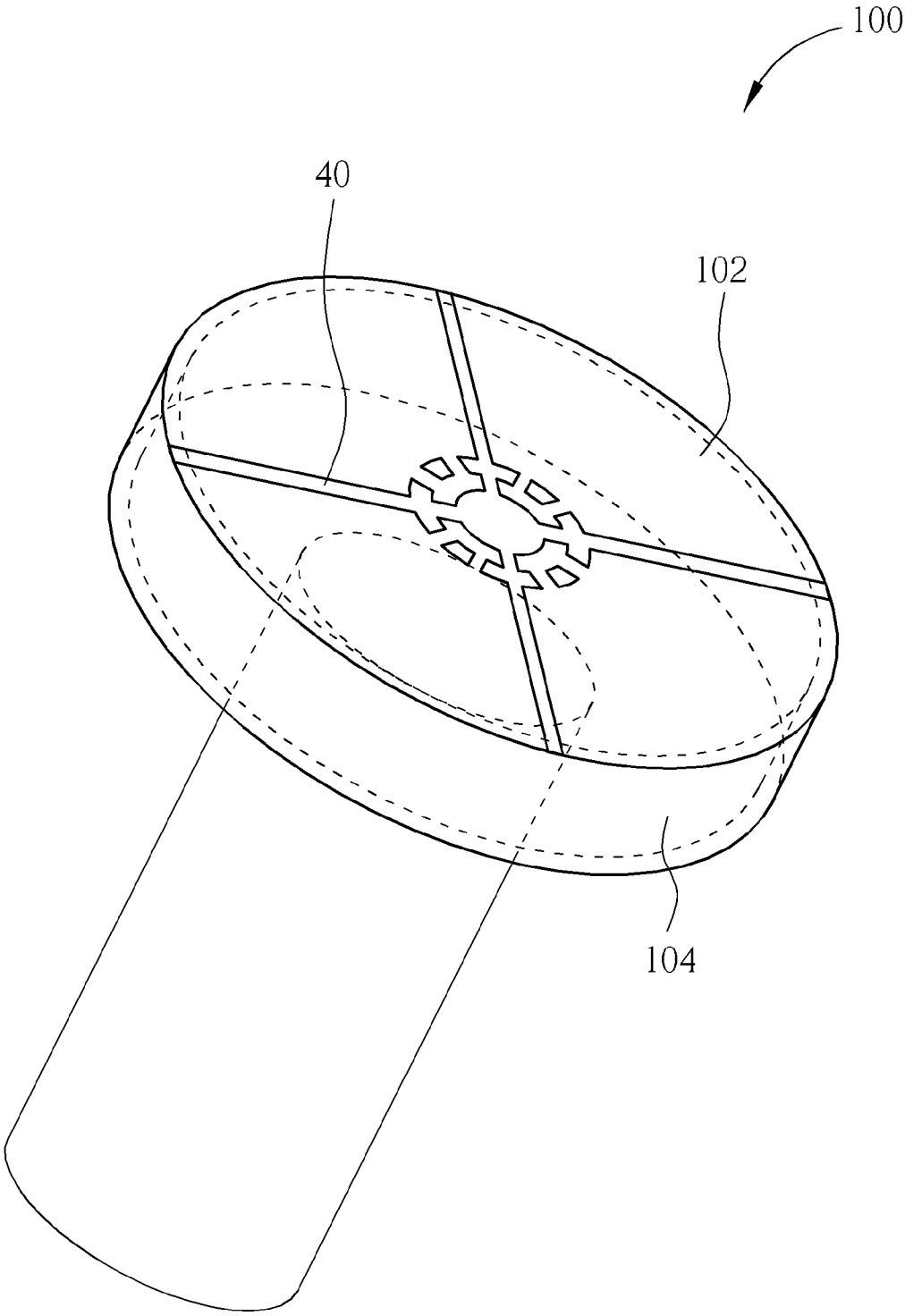
Figure 5:
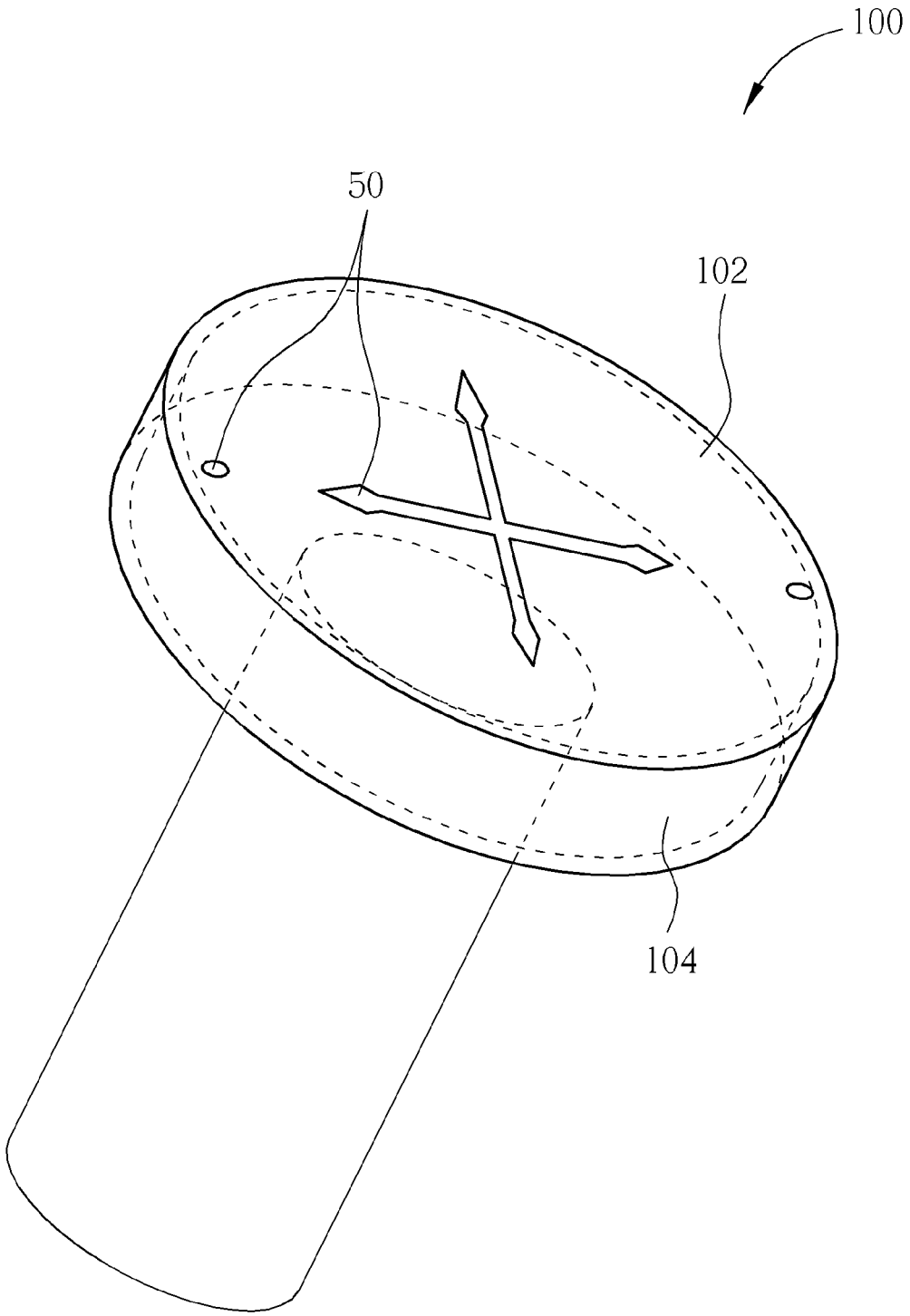

Therefore, the feedhorn 100 can obtain an optimization antenna gain through different shapes of the beamwidth adjustment devices. For example, please refer to FIG. 2-5, which illustrate schematic diagrams of beamwidth adjustment devices 20-50 according to embodiments of the present invention. In FIG. 2, the conductor of the beamwidth adjustment device 20 and the opening 102 are not located in the same plane and formed as a radiative circularity. In FIG. 3, the conductor of the beamwidth adjustment device 30 and the opening 102 are located in the same plane and formed as a concentric circularity. In FIG. 4, the conductor of the beamwidth adjustment device 40 and the opening 102 are located in the same plane and formed as a non-continuous circularity. In FIG. 5, the conductor of the beamwidth adjustment device 50 and the opening 102 are not located in the same plane and formed as an eccentric circularity. Therefore, the beamwidth adjustment devices 30, 40 of FIG. 3 and FIG. 4, can make high frequencies match the electric field reflection, so as to maintain the beam pattern. On the other hand, the beamwidth adjustment devices 20, 50 of FIG. 2 and FIG. 5, can adjust the beamwidth according to different frequencies, such as low, intermediate, or high frequency, to obtain a beamwidth appropriated for the design of the dish, so as to reduce antenna loss and obtain the optimization antenna gain. In addition, the beamwidth adjustment devices 10, 20, 30, 40, 50 of the present invention can be utilized for impedance match improvement, to reduce the return loss of the antenna.

Figure 6:
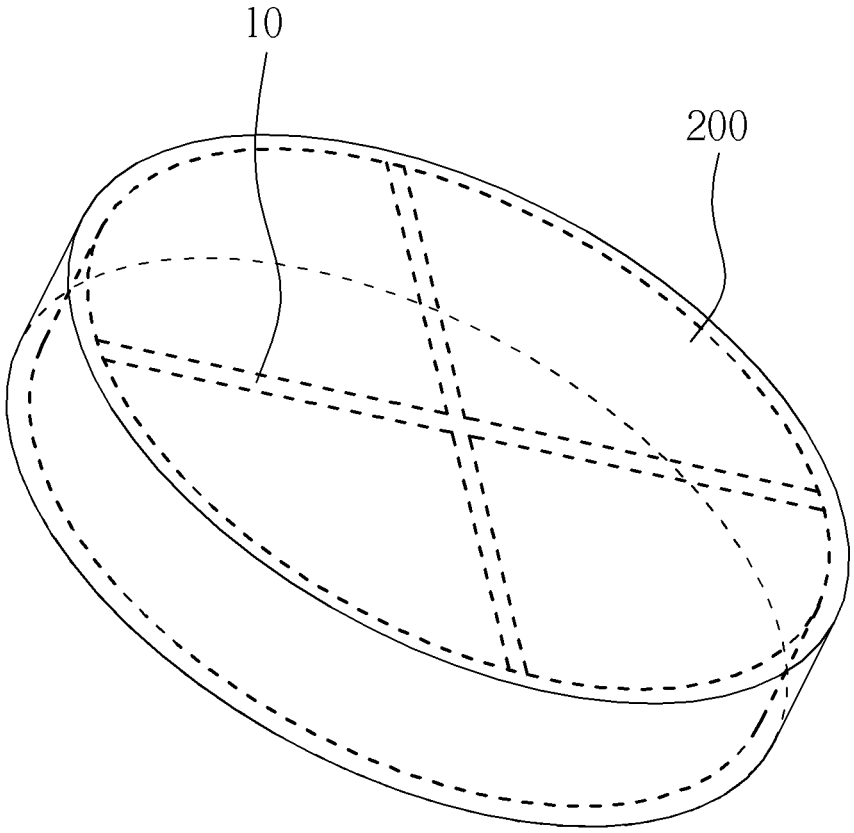
FIG. 6 is a schematic diagram of a waterproof component with the beamwidth adjustment device of FIG. 1.

From the above, except installation in the same plane of the opening 102 of the feedhorn 100, the beamwidth adjustment device of the present invention can be installed above or below the opening 102 as well. For example, in FIG. 6, the beamwidth adjustment device 10 is installed in a waterproof component 200 for covering the feedhorn 100, such as a feed cap. Furthermore, the beamwidth adjustment device 10 can be electroplated on the waterproof component 200 with a form of conductive film, be included in the water proof component 200 upon injection molding, or be installed on the waterproof component 200 with a metal foil form made of cupronickel oxide. Note that, except the beamwidth adjustment device 10, the beamwidth adjustment devices 20, 30, 40, 50 can be applied into the waterproof component 200 as well.

Figure 7:
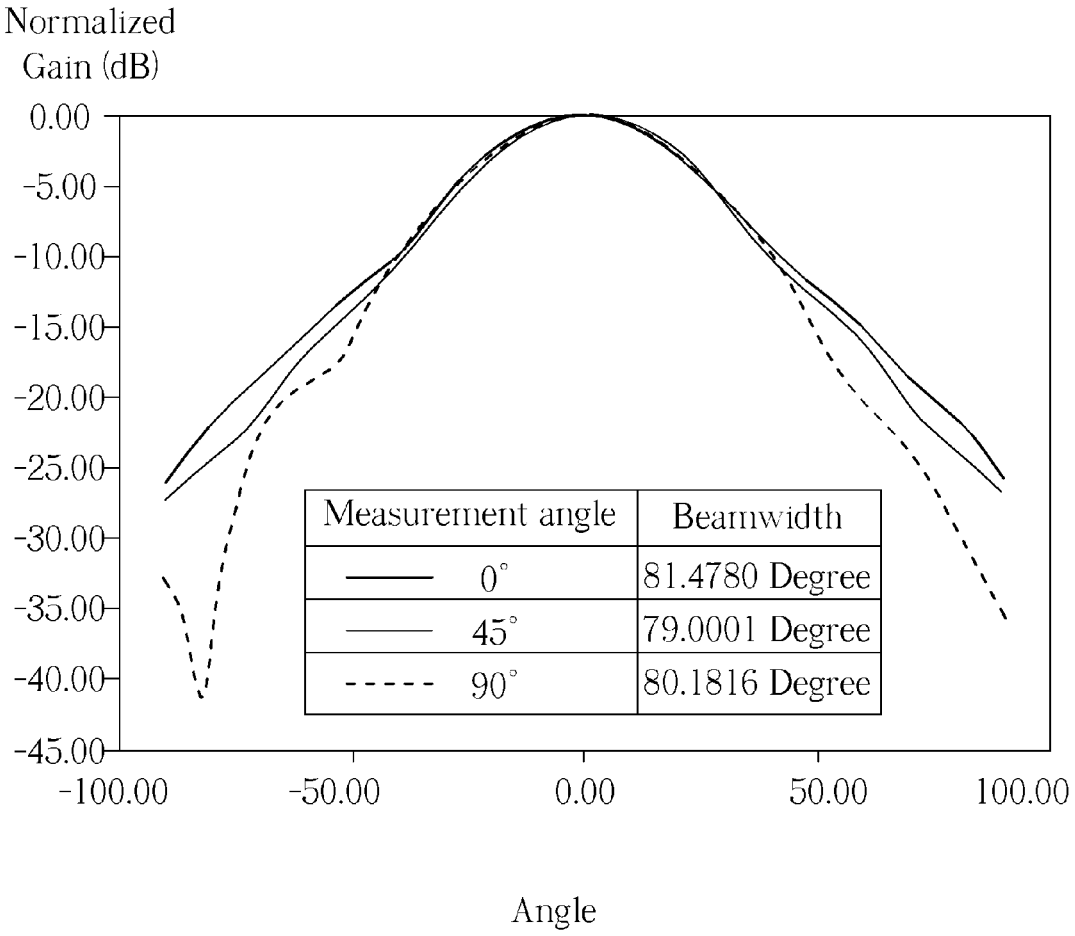
FIG. 7 is a schematic diagram of a beam emitted from the feedhorn without a beamwidth adjustment device according to an embodiment of the present invention.
Figure 8:
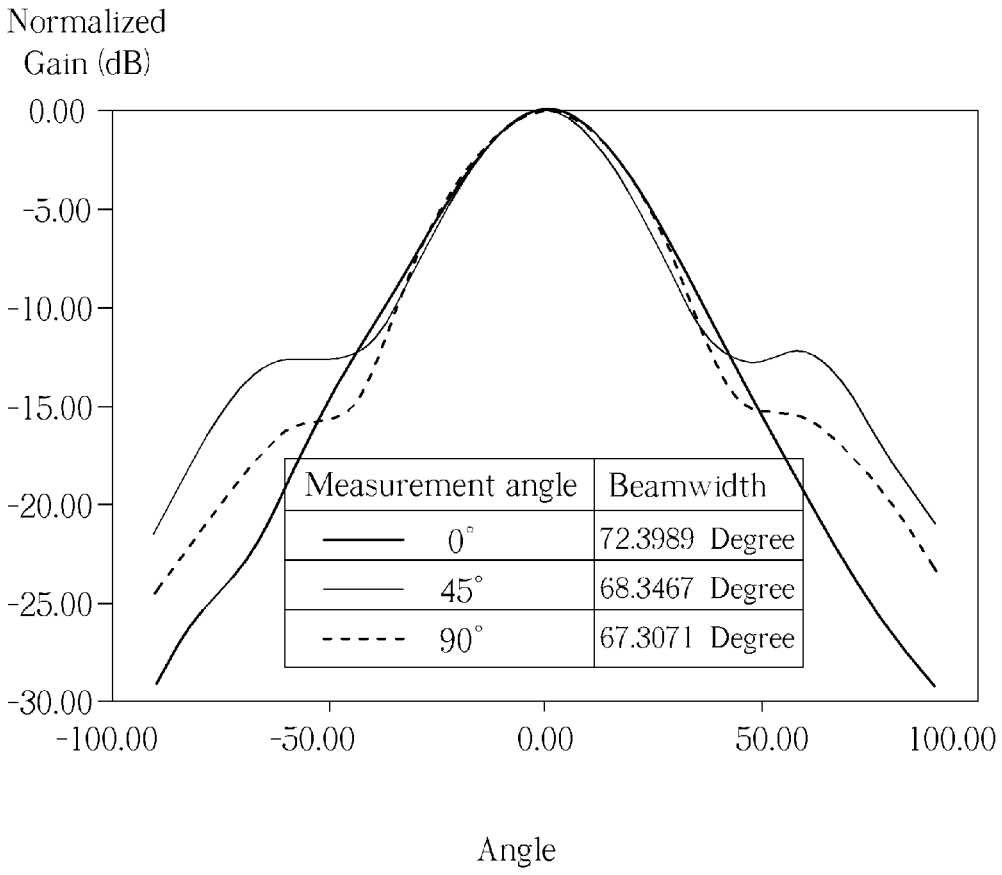
FIG. 8 is a schematic diagram of a beam emitted from the feedhorn of FIG. 1.
Figure 9:
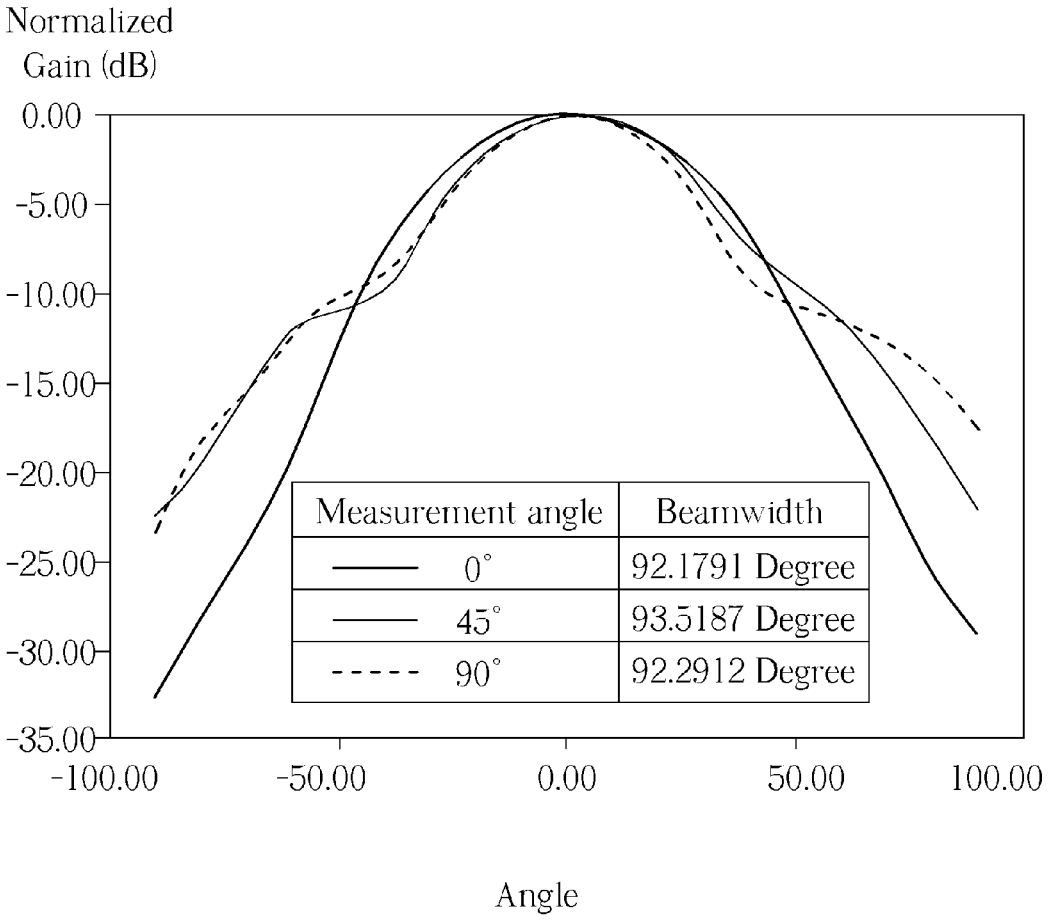
FIG. 9 is a schematic diagram of a beam emitted from the feedhorn of FIG. 3.

Please refer to FIG. 7-9, which are schematic diagrams of beams emitted from the feedhorn 100 operated in a frequency of 10.7 GHz without any beamwidth adjustment device, with the beamwidth adjustment device 10, and with the beamwidth adjustment device 30 respectively. As can be seen in FIG. 7-9, the beamwidth formed by the feedhorn 100 without the beamwidth adjustment device is wider than the beamwidth formed by the feedhorn 100 with the beamwidth adjustment device 10. Compared to FIG. 8-9, the beamwidth formed by the beamwidth adjustment device 10 with the shape of orthogonal cross is narrower than the beamwidth formed by the feedhorn 100 with no beamwidth adjustment device at 10 dB, and the beamwidth formed by the beamwidth adjustment device 30 with the shape of concentric circle is wider than the beamwidth formed by the feedhorn 100 with no beamwidth adjustment device at 10 dB. Please refer to FIG. 10, which is a comparison table of the beamwidths of FIG. 7-9. As can be seen in FIG. 10, the beamwidth of the feedhorn 100 without the beamwidth adjustment device is 80.22 degree (an average of the beamwidth measured in horizontal, vertical and 45 degree direction), whereas the beamwidth of the feedhorn 100 with beamwidth adjustment device 10 is 69.35 degree, so as to match the dish with F/D=0.6. On the other hand, the beamwidth of the feedhorn 100 with the beamwidth adjustment device 30 is 92.66 degree, thereby matching the dish with F/D=0.4. As can be seen, the beamwidth at 10 dB formed by the feedhorn 100 can be adjusted plus and minus 15 degree by the beamwidth adjustment device. Note that, the present invention can adjust the beamwidth to conform the characteristic of the satellite antenna without modification of the opening size of the feedhorn or a mold size.

In conclusion, in the prior art, the beamwidth can not be adjusted to match the dish perfectly, causing poor reception quality. In comparison, in the present invention a required beamwidth can be obtained for different dish designs (e.g. different F/D values) without modification the size of the feedhorn, so as to increase reception quality. Furthermore, with decrease opening size of the feedhorn, the beamwidth adjustment device of the present invention can maintain the same beamwidth to match the dish, so as to reduce cost efficiently.

Those skilled in the art will readily observe that numerous modifications and alterations of the device and method may be made while retaining the teachings of the invention.

What is claimed is:

1. A beamwidth adjustment device for a feedhorn comprising an opening and a ring encircling the opening, the beamwidth adjustment device comprising:

a conductor, for adjusting beamwidth formed by the feedhorn according to a characteristic of a dish of a satellite antenna corresponding to the feedhorn; and a fixing element, for fixing the conductor to the feedhorn via the ring, wherein the satellite antenna is used for receiving signals from the feedhorn;

the conductor is composed of a solid round pattern in the center of the conductor, one or more concentric circular patterns with a given width, and a cross pattern formed by two perpendicularly-crossed rectangles, wherein each circular pattern is uniformly cut to a plurality of arcs by a constant spacing, a center of the one or more concentric circular patterns and the cross point of the cross pattern are aligned with the center of the conductor, and four arcs of each circular pattern perpendicularly cross a rectangle of the cross pattern; or the conductor is composed of a cross pattern formed by two perpendicularly-crossed arrows and two spots aligned with a direction pointed by an arrow.

2. The beamwidth adjustment device of claim 1, wherein the characteristic of the dish is a focal length to diameter ratio (F/D).

3. The beamwidth adjustment device of claim 1, wherein the conductor is placed above, below or in the same plane of the opening of the feedhorn.

4. The beamwidth adjustment device of claim 1, wherein the conductor is placed in a waterproof component used for covering the opening of the feedhorn.

5. The beamwidth adjustment device of claim 4, wherein the conductor is electroplated on the waterproof component with a form of a conductive film, or is placed in the waterproof component with a metal foil form.

6. The beamwidth adjustment device of claim 1, wherein the conductor and the opening are not in the same plane.

7. A beamwidth adjustment device for a feedhorn comprising an opening and a ring encircling the opening, the beamwidth adjustment device comprising:

a conductor, for adjusting beamwidth formed by the feedhorn according to a characteristic of a dish of a satellite antenna corresponding to the feedhorn; and a fixing element, for fixing the conductor to the feedhorn via the ring, wherein the satellite antenna is used for receiving signals from the feedhorn;

wherein the conductor is composed of a ring pattern with a given width, and a plurality of inner segments distributed within an inner side of the ring pattern and a plurality of corresponding outer segments distributed at an outer side opposite to the inner side of the ring pattern, wherein the inner side encircles a circular opening of the ring pattern and the outer side encircles the ring pattern and the circular opening of the ring pattern, and the plurality of inner segments and the plurality of outer segments are connected with the ring pattern, wherein the plurality of inner segments are one by one aligned with the plurality of outer segments at the ring pattern.

* * * * *